US011437182B2

(12) United States Patent
Yamaguchi et al.

(10) Patent No.: US 11,437,182 B2
(45) Date of Patent: Sep. 6, 2022

(54) ELECTRONIC COMPONENT AND METHOD OF MANUFACTURING ELECTRONIC COMPONENT

(71) Applicant: Murata Manufacturing Co., Ltd., Kyoto (JP)

(72) Inventors: Koichi Yamaguchi, Nagaokakyo (JP); Koshi Himeda, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 696 days.

(21) Appl. No.: 16/175,564

(22) Filed: Oct. 30, 2018

(65) Prior Publication Data

US 2019/0156991 A1 May 23, 2019

(30) Foreign Application Priority Data

Nov. 20, 2017 (JP) ..... JP2017-222499

(51) Int. Cl.
*H01F 27/29* (2006.01)
*H01F 27/32* (2006.01)
(Continued)

(52) U.S. Cl.
CPC ..... *H01F 27/292* (2013.01); *H01F 17/0013* (2013.01); *H01F 27/022* (2013.01);
(Continued)

(58) Field of Classification Search
CPC .. H01F 27/292; H01F 17/0013; H01F 41/041; H01F 27/327; H01F 27/06; H01F 41/127; H01F 27/022
See application file for complete search history.

(56) References Cited

U.S. PATENT DOCUMENTS 10,219,380 B2 * 2/2019 Yoo ..... H05K 1/181
2003/0085058 A1 * 5/2003 Komatsu ..... H05K 3/4069 174/264

(Continued)

FOREIGN PATENT DOCUMENTS

CN 102484950 A 5/2012
JP H10-233322 A 9/1998

(Continued)

OTHER PUBLICATIONS

An Office Action; "Notification of Reasons for Refusal," Mailed by the Japanese Patent Office dated Jan. 28, 2020, which corresponds to Japanese Patent Application No. 2017-222499 and is related to U.S. Appl. No. 16/175,564; with English language translation.

(Continued)

*Primary Examiner* — Tuyen T Nguyen
(74) *Attorney, Agent, or Firm* — Studebaker & Brackett PC

(57) ABSTRACT

An electronic component comprising a coil component having an element body containing ceramic, a coil disposed in the element body, and an external electrode disposed in the element body and electrically connected to the coil; and a mold resin sealing the coil component. The electronic component further comprises an electrode film in contact with an outer surface of the mold resin; and a connection conductor disposed in the mold resin and electrically connecting the external electrode and the electrode film.

6 Claims, 7 Drawing Sheets

(51) Int. Cl.

| | |
|---|---|
| ***H01F 27/06*** | (2006.01) |
| ***H01F 41/12*** | (2006.01) |
| ***H01F 27/02*** | (2006.01) |
| ***H01F 17/00*** | (2006.01) |
| ***H01F 41/04*** | (2006.01) |

(52) U.S. Cl.
CPC ..... *H01F 27/06* (2013.01); *H01F 27/327* (2013.01); *H01F 41/041* (2013.01); *H01F 41/127* (2013.01)

(56) References Cited

U.S. PATENT DOCUMENTS

| | | | | |
|---|---|---|---|---|
| 2009/0160595 | A1* | 6/2009 | Feng | H01L 23/49861 336/200 |
| 2010/0101836 | A1* | 4/2010 | Sekimoto | H05K 1/187 174/251 |
| 2010/0236698 | A1* | 9/2010 | Sekimoto | H05K 3/4069 156/221 |
| 2012/0145445 | A1 | 6/2012 | Arai et al. | |
| 2016/0020032 | A1 | 1/2016 | Shin et al. | |
| 2016/0181003 | A1* | 6/2016 | Li | H01F 27/2895 336/200 |
| 2022/0139611 | A1* | 5/2022 | Takubo | H01F 27/292 336/192 |

FOREIGN PATENT DOCUMENTS

| | | | |
|---|---|---|---|
| JP | 2002-313601 | A | 10/2002 |
| JP | 2015-216338 | A | 12/2015 |
| WO | 2017/119249 | A1 | 7/2017 |

OTHER PUBLICATIONS

An Office Action mailed by the China National Intellectual Property Administration dated Jul. 1, 2020, which corresponds to Chinese Patent Application No. 201811365058.0 and is related to U.S. Appl. No. 16/175,564 with English language translation.

* cited by examiner

ELECTRONIC COMPONENT AND METHOD OF MANUFACTURING ELECTRONIC COMPONENT

CROSS REFERENCE TO RELATED APPLICATION

This application claims benefit of priority to Japanese Patent Application 2017-222499 filed Nov. 20, 2017, the entire content of which is incorporated herein by reference.

BACKGROUND

Technical Field

The present disclosure relates to an electronic component and a method of manufacturing an electronic component.

Background Art

A conventional coil component is described in Japanese Laid-Open Patent Publication No. 2015-216338. This coil component has an element body containing ceramic, a coil disposed in the element body, and an external electrode disposed on the element body and electrically connected to the coil.

SUMMARY

It was found that the following problem exists when an external electrode of a conventional coil component as described above is fixed to a mounting substrate via solder to mount the coil component on the mounting substrate.

The element body of the coil component contains ceramic and therefore has rigidity. Thus, even if deflection occurs in the mounting substrate due to an external force, heat, etc., the element body is hardy deflected, so that a deflection stress directly acts on the external electrode. As a result, the external electrode may peel from the element body or the mounting substrate, or the external electrode may be disconnected.

Therefore, the present disclosure provides an electronic component and a method of manufacturing an electronic component capable of suppressing peeling of an external electrode and disconnection of an external electrode.

In particular, an aspect of the present disclosure provides an electronic component comprising a coil component having an element body containing ceramic, a coil disposed in the element body, and an external electrode disposed in the element body and electrically connected to the coil; a mold resin sealing the coil component; an electrode film in contact with an outer surface of the mold resin; and a connection conductor disposed in the mold resin and electrically connecting the external electrode and the electrode film.

According to the electronic component of the present disclosure, since the coil component is sealed with the mold resin, even when the electronic component is mounted on a mounting substrate and deflection occurs in the mounting substrate, the mold resin absorbs the deflection of the mounting substrate, and a stress hardly acts on the coil component. Therefore, peeling of the external electrode and disconnection of the external electrode can be suppressed.

In one embodiment of the electronic component, one principal surface of the coil component and one principal surface of the mold resin face in the same direction. Also, the electrode film is in contact with the one principal surface of the mold resin, and the connection conductor extends from the one principal surface of the mold resin toward the one principal surface of the coil component. According to the embodiment, after the hole is made in the mold resin from the one principal surface of the mold resin toward the one principal surface of the coil component, the connection conductor can be disposed in this hole, so that the connection conductor can easily be manufactured.

In an embodiment of the electronic component, the electronic component further comprises a substrate, and the connection conductor is disposed on the one principal surface of the substrate with the coil component placed on the connection conductor so that the external electrode and the connection conductor are electrically connected, while the mold resin seals the coil component on the one principal surface side of the substrate. Also, the connection conductor extends along the one principal surface of the substrate and is exposed from an end surface of the mold resin, while the electrode film is in contact with the end surface of the mold resin and in contact with the connection conductor. According to the embodiment, the coil component can be sealed with the mold resin after disposing the coil component on the substrate, so that the electronic component can easily be manufactured.

An embodiment of a method of manufacturing an electronic component provides a method of manufacturing an electronic component comprising the steps of sealing a coil component having an element body containing ceramic, a coil disposed in the element body, and an external electrode disposed in the element body and electrically connected to the coil, with a mold resin; and disposing an electrode film in contact with one principal surface of the mold resin, making a hole from the one principal surface of the mold resin toward one principal surface of the coil component, and disposing a connection conductor in the hole to electrically connect the external electrode and the electrode film. According to the embodiment, the electronic component capable of suppressing peeling of the external electrode and disconnection of the external electrode can be manufactured.

An embodiment of a method of manufacturing an electronic component provides a method of manufacturing an electronic component comprising the steps of placing a coil component having an element body containing ceramic, a coil disposed in the element body, and an external electrode disposed in the element body and electrically connected to the coil, on a connection conductor disposed on one principal surface of a substrate to electrically connect the external electrode and the connection conductor; sealing the coil component with a mold resin on the one principal surface side of the substrate; and exposing the connection conductor from an end surface of the mold resin and disposing an electrode film in contact with the mold resin and in contact with the connection conductor. According to the embodiment, the electronic component capable of suppressing peeling of the external electrode and disconnection of the external electrode can be manufactured.

The electronic component and the method for manufacturing an electronic component according to an aspect of the present disclosure can suppress peeling of the external electrode and disconnection of the external electrode.

DETAILED DESCRIPTION

An aspect of the present disclosure will now be described in detail with shown embodiments.

First Embodiment

Figure 1:
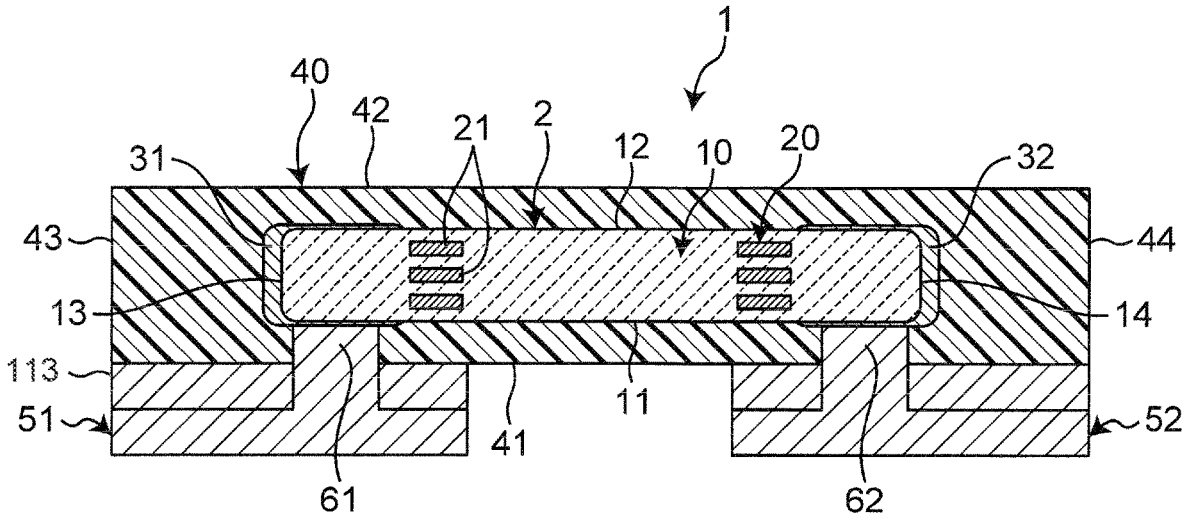
FIG. 1 is a cross-sectional view of a first embodiment of an electronic component.

FIG. 1 is a cross-sectional view of a first embodiment of an electronic component. As shown in FIG. 1, an electronic component 1 includes a coil component 2, a mold resin 40 sealing the entire the coil component 2, electrode films 51, 52 in contact with an outer surface of the mold resin 40, and connection conductors 61, 62 disposed inside the mold resin 40. The coil component 2 includes an element body 10 containing ceramic, a coil 20 disposed inside the element body 10, and external electrodes 31, 32 disposed on the element body 10 and electrically connected to the coil 20.

The element body 10 is formed by laminating multiple insulating layers. The insulating layer are made of a ceramic material such as ferrite and alumina, for example. An interface between the adjacent insulating layers may not be clear due to firing etc. The element body 10 is formed in a flat plate shape. The outer surface of the element body 10 includes a first principal surface 11 and a second principal surface 12 opposite to each other and a first end surface 13 and a second end surface 14 opposite to each other. The first principal surface 11 and the second principal surface 12 are connected between the first end surface 13 and the second end surface 14.

The first external electrode 31 and the second external electrode 32 are made of a conductive material such as Ag, Cu, Au, and an alloy mainly composed thereof, for example. The first external electrode 31 and the second external electrode 32 may contain a component such as resin or glass other than the conductive material. The first external electrode 31 is disposed to extend from the first end surface 13 onto the first principal surface 11 and the second principal surface 12. The second external electrode 32 is disposed to extend from the second end surface 14 onto the first principal surface 11 and the second principal surface 12.

The coil 20 is made of the same conductive material as the first and second external electrodes 31, 32, for example. The coil 20 is helically wound along a direction orthogonal to the principal surfaces 11, 12 of the element body 10. One end of the coil 20 is in contact with the first external electrode 31, and the other end of the coil 20 is in contact with the second external electrode 32.

The coil 20 includes multiple coil conductor layers 21 each wound on a plane on an insulating layer of the element body. Therefore, the multiple coil conductor layers 21 are laminated via the insulating layer. The coil conductor layers 21 adjacent to each other in the lamination direction are electrically connected in series through a via conductor penetrating the insulating layer in the thickness direction. The multiple coil conductor layers 21 are electrically connected to each other in series in this way to constitute a helix. Specifically, the coil 20 has a laminated configuration of the multiple coil conductor layers 21 electrically connected to each other in series and having the number of turns less than one, and the coil 20 has a helical shape. However, the coil 20 is not limited to this configuration and may have a laminated configuration of the multiple spiral-shaped coil conductor layers 21 having the number of turns equal to or greater than one.

The mold resin 40 is made of, for example, an imide resin such as bismaleimide or a thermosetting resin such as an epoxy resin. The mold resin 40 has elasticity as compared to the element body 10. The outer surface of the mold resin 40 includes a first principal surface 41 and a second principal surface 42 opposite to each other and a first end surface 43 and a second end surface 44 opposite to each other. The first principal surface 41 and the second principal surface 42 are connected between the first end surface 43 and the second end surface 44.

The first principal surface 11 of the element body 10 of the coil component 2 and the first principal surface 41 of the mold resin 40 face in the same direction. The first end surface 13 of the element body 10 of the coil component 2 and the first end surface 43 of the mold resin 40 face in the same direction.

The first electrode film 51 and the second electrode film 52 are film-like metal members made of the same conductive material as the first and second external electrodes 31, 32, for example. The first and second electrode films 51, 52 are in contact with the first principal surface 41 of the mold resin 40. The first and second electrode films 51, 52 are brought into close contact with the first principal surface 41 in a planar manner by plating or sputtering, for example.

The first connection conductor 61 and the second connection conductor 62 are made of the same conductive material as the first and second electrode films 51, 52, for example. The first connection conductor 61 electrically connects the first external electrode 31 and the first electrode film 51. The second connection conductor 62 electrically connects the second external electrode 32 and the second electrode film 52. The first and second connection conductors 61, 62 extend from the first principal surface 41 of the mold resin 40 toward the first principal surface 11 of the coil component 2. Therefore, after holes are made in the mold resin 40 from the first principal surface 41 of the mold resin 40 toward the first principal surface 11 of the coil component 2, the first and second connection conductors 61, 62 can be disposed in this hole, so that the first and second connection conductors 61, 62 can easily be manufactured. Although integrally and continuously formed in a two-layer structure in FIG. 1, the first electrode film 51 and the first connection conductor 61 may separately and discontinuously be formed. The same applies to the second electrode film 52 and the second connection conductor 62.

According to the electronic component 1, when the electronic component 1 is mounted on a mounting substrate (not shown), the electrode films 51, 52 of the electronic component 1 are fixed to the mounting substrate via solder. In this case, since the coil component 2 is sealed with the mold resin 40, even if deflection occurs in the mounting substrate due to an external force or heat, the elastic mold resin 40 absorbs the deflection of the mounting substrate, and a stress hardly acts on the coil component 2. Therefore, the external electrodes 31, 32 can be restrained from peeling from the element body 10 or the mounting substrate, and disconnection of the external electrodes 31, 32 can be suppressed. For example, the component is suitably used on a vehicle with large temperature changes.

Since the coil component 2 can be used alone, the existing coil component 2 can be applied. Additionally, since the electrode films 51, 52 used are film-like metal members, the need for a forming process can be eliminated as compared to a metal frame terminal, so that the electronic component 1 can be reduced in thickness, and the flatness of the electrode films 51, 52 can be maintained. In contrast, when the metal frame terminal is used, a dimensional variation is relatively increased due to the forming process, which prevents a reduction in thickness, and this also makes it difficult to maintain the flatness of the bottom surface of the metal frame terminal A method of manufacturing the electronic component 1 will be described.

Figure 2A:
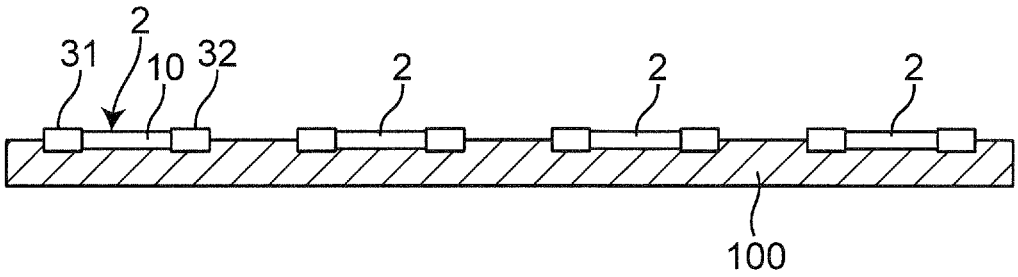
FIG. 2A is an explanatory view for explaining a method of manufacturing the electronic component.
Figure 2B:
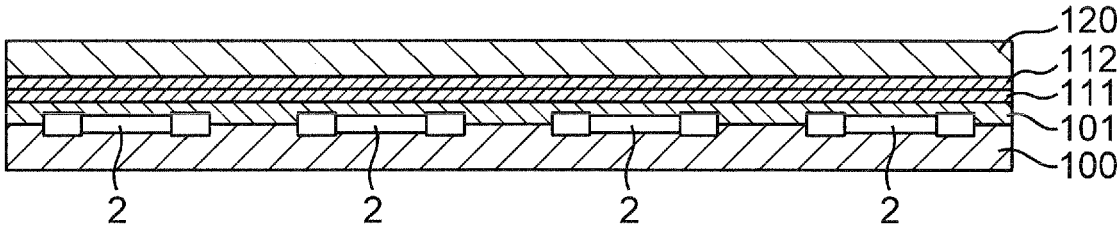
FIG. 2B is an explanatory view for explaining the method of manufacturing the electronic component.

As shown in FIG. 2A, the coil components 2 are shaken in and aligned on an alignment pallet 100 made of Teflon (registered trademark) or release-treated aluminum. As shown in FIG. 2B, for example, a flat plate-shaped first mold resin 101 such as bismaleimide is disposed to cover the entire alignment palette 100 and, for example, a substrate 120 such as FR4 with first carrier copper 111 and second carrier copper 112 is further disposed on the first mold resin 101 before heating and pressurizing one surfaces (principal surfaces) of the coil components 2 for molding.

Figure 2C:
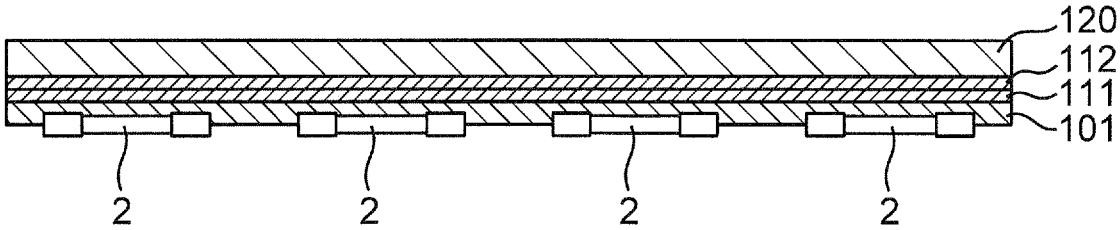
FIG. 2C is an explanatory view for explaining the method of manufacturing the electronic component.
Figure 2D:
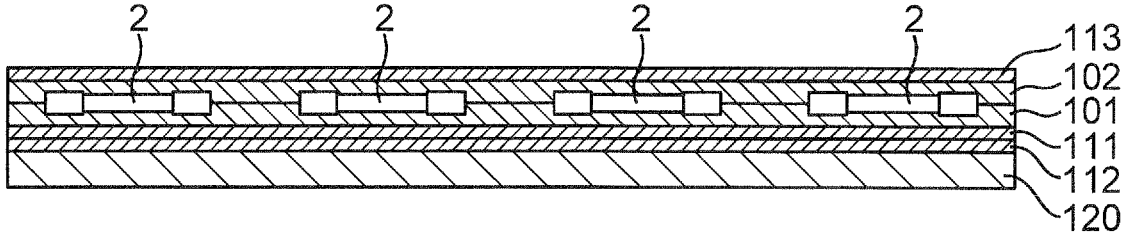
FIG. 2D is an explanatory view for explaining the method of manufacturing the electronic component.

As shown in FIG. 2C, the coil components 2 with the one surfaces molded are demolded from the alignment pallet 100. As shown in FIG. 2D, also on the other exposed surfaces (principal surfaces) of the coil components 2, a flat plate-shaped second mold resin 102 such as bismaleimide with a copper foil 113 is disposed to cover the entire other surfaces of the coil components 2 before heating and pressurizing the other surfaces of the coil components 2 for molding. In this way, the entire coil components 2 are sealed with the first and second mold resins 101, 102. The second mold resin 102 may be disposed by using the same substrate 120 as in FIG. 2B.

Figure 2E:
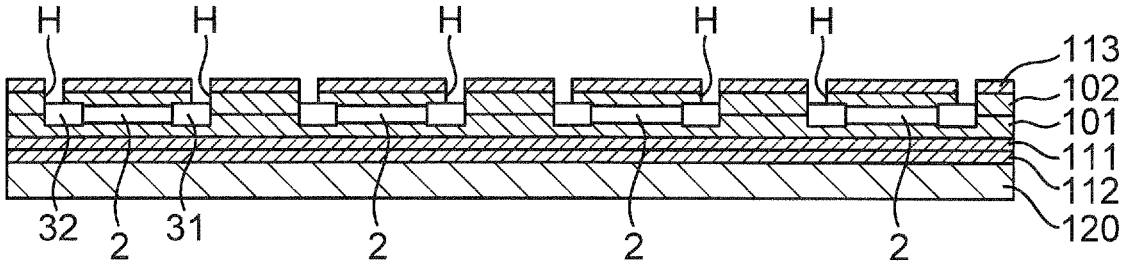
FIG. 2E is an explanatory view for explaining the method of manufacturing the electronic component.
Figure 2F:
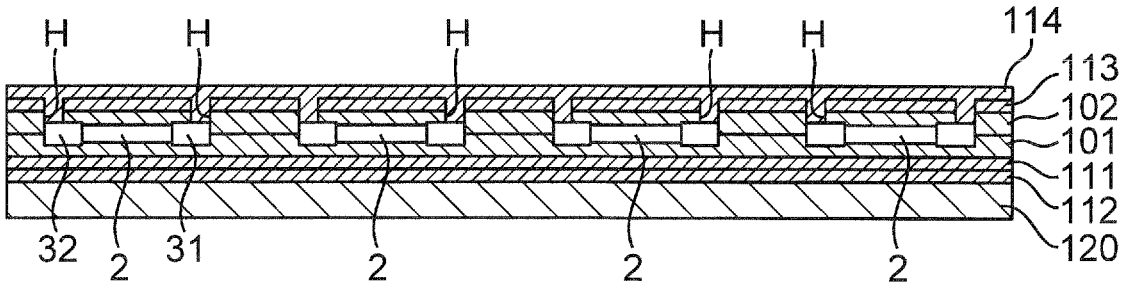
FIG. 2F is an explanatory view for explaining the method of manufacturing the electronic component.

As shown in FIG. 2E, holes H are made in the copper foil 113 and the second mold resin 102 to reach the external electrodes 31, 32 of the coil components 2 from the surface of the copper foil 113 with a laser drill. As shown in FIG. 2F, electroless copper plating and electrolytic copper plating are performed to fill the hole H with a conductor part 114 to form the continuous conductor part 114 from the external electrodes 31, 32 of the coil components 2 to the surface of the copper foil 113.

The copper foil 113 and the conductor portion 114 constitute the electrode films 51, 52 and the connection conductors 61, 62 shown in FIG. 1. The first and second mold resins 101, 102 constitute the mold resin 40 shown in FIG. 1. Therefore, in FIGS. 2D to 2F, the electrode films 51, 52 in contact with one principal surface of the mold resin 40 are disposed, and the holes H are formed from the one principal surface of the mold resin 40 toward the one principal surfaces of the coil components 2, and the connection conductors 61, 62 are disposed in the holes H to electrically connect the external electrodes 31, 32 and the electrode films 51, 52.

Figure 2G:
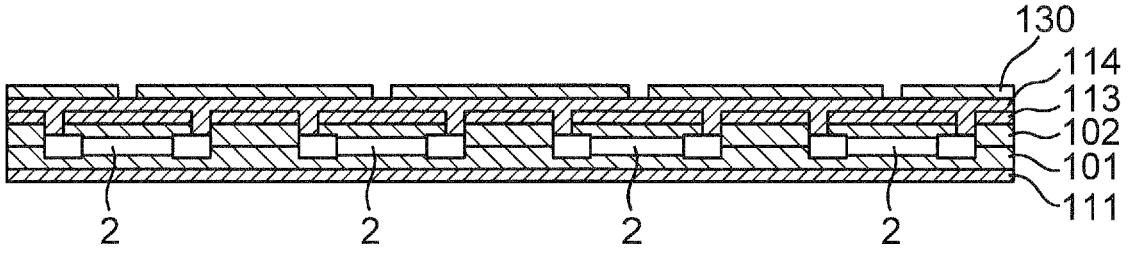
FIG. 2G is an explanatory view for explaining the method of manufacturing the electronic component.

As shown in FIG. 2G, for example, a dry film resist 130 is affixed to the surface of the conductor portion 114, and after the resist 130 is patterned, the substrate 120 with the second carrier copper 112 is peeled off.

Figure 2H:
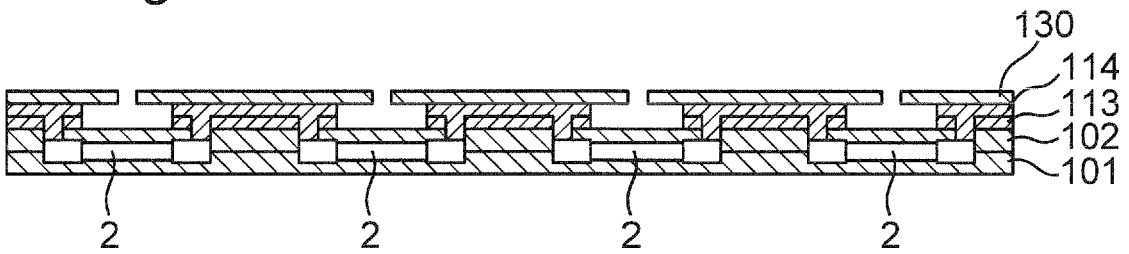
FIG. 2H is an explanatory view for explaining the method of manufacturing the electronic component.
Figure 2I:
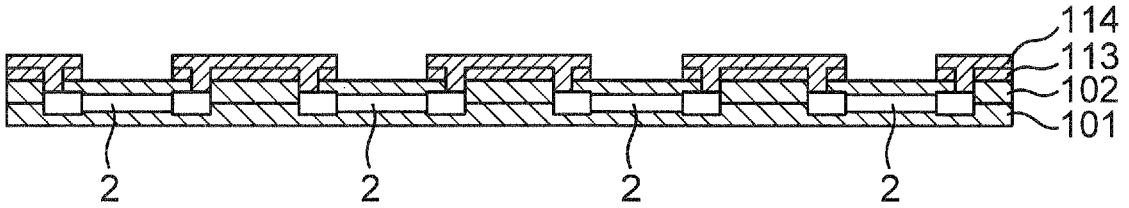
FIG. 2I is an explanatory view for explaining the method of manufacturing the electronic component.
Figure 2J:
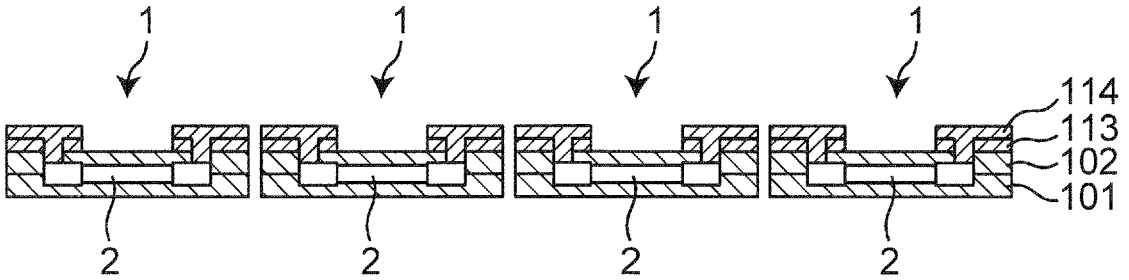
FIG. 2J is an explanatory view for explaining the method of manufacturing the electronic component.

As shown in FIG. 2H, the first carrier copper 111, the copper foil 113, and the conductor part 114 are etched with ferric chloride. As shown in FIG. 2I, the remaining resist 130 is also peeled. As shown in FIG. 2J, a molded body having the multiple molded coil components 2 is cut into individual pieces by a dicer, laser cutting, etc. to manufacture the electronic component 1 shown in FIG. 1.

Therefore, the electronic component 1 capable of suppressing the peeling of the external electrodes 31, 32 and the disconnection of the external electrodes 31, 32 can be manufactured. Additionally, since the electrode films 51, 52 and the connection conductors 61, 62 are disposed after the coil component 2 is molded, burrs are hardly generated in the mold resin 40. In contrast, if a metal frame terminal is attached to a coil component before molding, the component is sandwiched between dies for molding such that the terminal is exposed from the mold resin, and therefore, burrs of the mold resin are likely to be generated from a gap of the mold dies.

Second Embodiment

Figure 3:
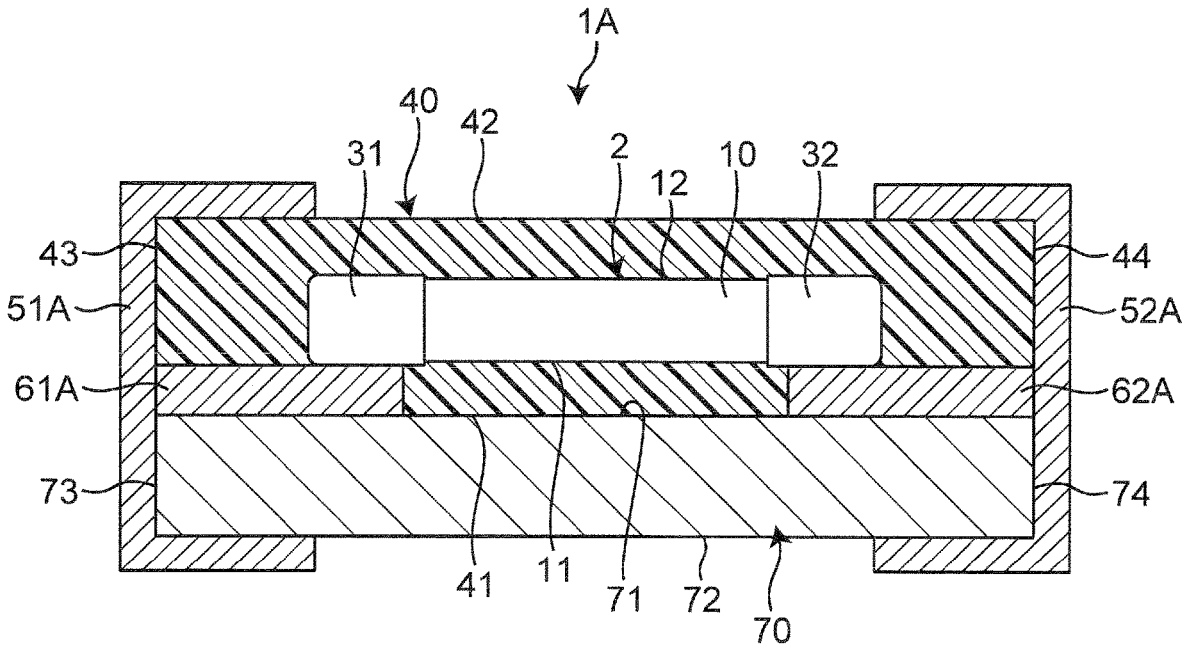
FIG. 3 is a cross-sectional view of a second embodiment of an electronic component.

FIG. 3 is a cross-sectional view of a second embodiment of an electronic component. The second embodiment is different from the first embodiment in the configuration of the substrate, the electrode film, and the connection conductor. This different configuration will hereinafter be described. The other constituent elements have the same configuration as the first embodiment and are denoted by the same reference numerals as the first embodiment and will not be described.

As shown in FIG. 3, an electronic component 1A of the second embodiment further includes a substrate 70. The substrate 70 is, for example, a printed substrate. An outer surface of the substrate 70 includes a first principal surface 71 and a second principal surface 72 opposite to each other and a first end surface 73 and a second end surface 74 opposite to each other. The first principal surface 71 and the second principal surface 72 are connected between the first end surface 73 and the second end surface 74.

A first connection conductor 61A and a second connection conductor 62A are disposed on the first principal surface 71 of the substrate 70. The first and second connection conductors 61A, 62A are electrode patterns disposed on the substrate 70, for example.

The coil component 2 is placed on the first and second connection conductors 61A, 62A. Specifically, the first external electrode 31 is placed on the first connection conductor 61A so that the first external electrode 31 is electrically connected to the first connection conductor 61A. The second external electrode 32 is placed on the second connection conductor 62A so that the second external electrode 32 is electrically connected to the second connection conductor 62A.

The mold resin 40 seals the coil component 2 on the first principal surface 71 side of the substrate 70. Therefore, the first principal surface 41 of the mold resin 40 is in contact with the first principal surface 71 of the substrate 70.

The first connection conductor 61A extends along the first principal surface 71 of the substrate 70 and is exposed from the first end surface 43 of the mold resin 40. The second connection conductor 62A extends along the first principal surface 71 of the substrate 70 and is exposed from the second end surface 44 of the mold resin 40.

A first electrode film 51A is in contact with the first end surface 43 of the mold resin 40 and in contact with the first connection conductor 61A. Specifically, the first electrode film 51A covers the first end surface 43 of the mold resin 40 and the first end surface 73 of the substrate 70 and is disposed also on the second principal surface 42 of the mold resin 40 and the second principal surface 72 of the substrate 70.

The second electrode film 52A is in contact with the second end surface 44 of the mold resin 40 and in contact with the second connection conductor 62A. Specifically, the second electrode film 52A covers the second end surface 44 of the mold resin 40 and the second end surface 74 of the substrate 70 and is disposed also on the second principal surface 42 of the mold resin 40 and the second principal surface 72 of the substrate 70.

According to the electronic component 1A, the coil component 2 can be sealed with the mold resin 40 after disposing the coil component 2 on the substrate 70, so that the electronic component 1A can easily be manufactured.

A method of manufacturing the electronic component 1A will be described.

Figure 4A:
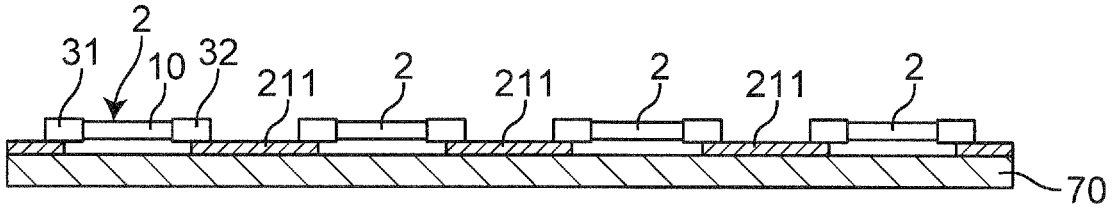
FIG. 4A is an explanatory view for explaining a method of manufacturing the electronic component.

As shown in FIG. 4A, the coil components 2 are aligned on the substrate 70. The substrate 70 is a printed substrate, and electrode patterns 211 are disposed on the substrate 70 as the connection conductors 61A, 62A. The external electrodes 31, 32 of the coil components 2 are fixed to the electrode patterns 211 by reflow soldering. Therefore, the coil components 2 are placed on the connection conductors 61A, 62A disposed on one surface (principal surface) of the substrate 70 to electrically connect the external electrodes 31, 32 and the connection conductors 61A, 62A.

Figure 4B:
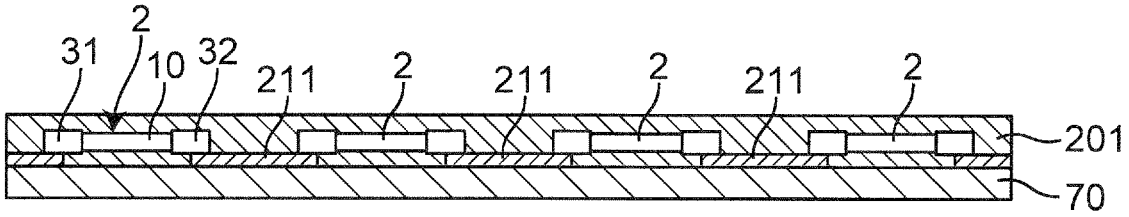
FIG. 4B is an explanatory view for explaining the method of manufacturing the electronic component.

As shown in FIG. 4B, a flat plate-shaped mold resin 201 is disposed to cover the one surface (principal surface) of the substrate 70 before heating and pressurizing for molding the entire coil components 2. Therefore, the entire coil components 2 are sealed with the mold resin 201 on the one surface side of the substrate 70.

Figure 4C:
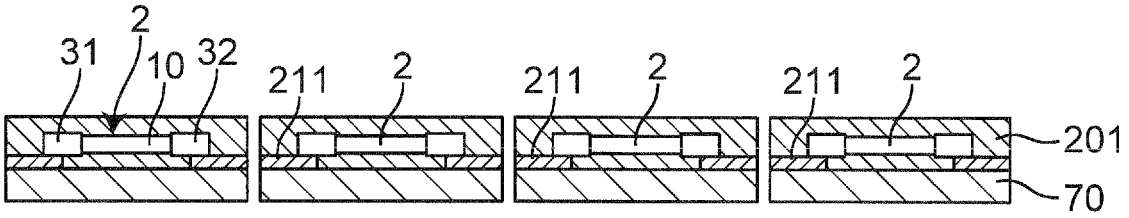
FIG. 4C is an explanatory view for explaining the method of manufacturing the electronic component.
Figure 4D:
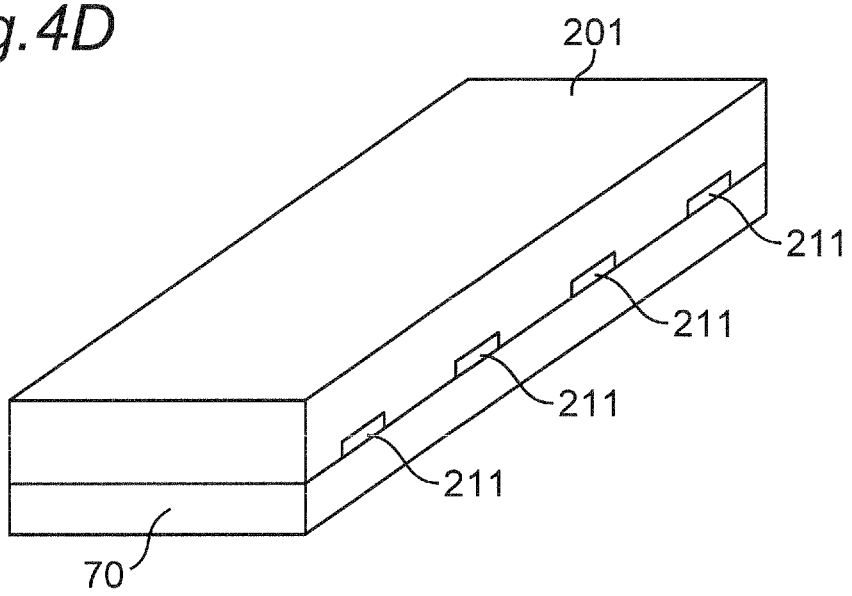
FIG. 4D is an explanatory view for explaining the method of manufacturing the electronic component.

As shown in FIG. 4C, a molded body having the multiple molded coil components 2 is cut into strips by a dicer, laser cutting, etc., such that the coil components are arranged in line as shown in FIG. 4D. In this state, the electrode patterns 211 are exposed from the cut end surfaces of the mold resin 201. Therefore, the connection conductors 61A, 62A are exposed from the end surfaces of the mold resin 201.

Figure 4E:
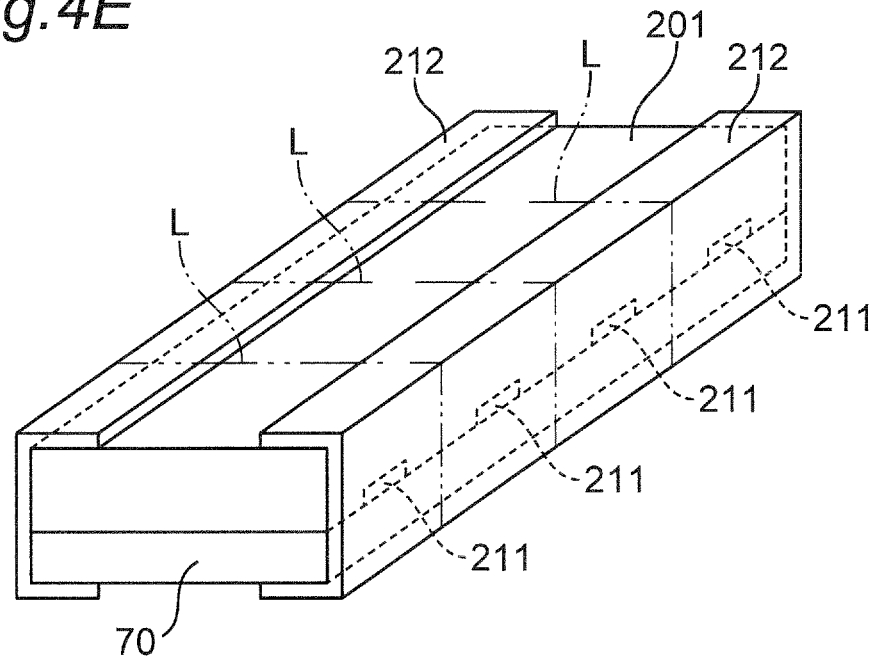
FIG. 4E is an explanatory view for explaining the method of manufacturing the electronic component.

As shown in FIG. 4E, U-shaped electrode films 212 are formed on the cut end surfaces of the mold resin 201 by plating etc. Therefore, the electrode films 212 (corresponding to the electrode films 51A, 52A) are in contact with the end surfaces of the mold resin 201 and in contact with the connection conductors 61A, 62A. Lastly, the strip-shaped molded body is cut along imaginary lines L into individual pieces by a dicer, laser cutting, etc. to manufacture the electronic component 1A shown in FIG. 3.

Therefore, the electronic component 1A capable of suppressing peeling of the external electrodes 31, 32 and disconnection of the external electrodes 31, 32 can be manufactured.

The present disclosure is not limited to the embodiments described above and may be changed in design without departing from the spirit of the present disclosure. For example, respective feature points of the first and second embodiments may variously be combined.

Although the electrode films are disposed only on the principal surface of the mold resin in the first embodiment, the electrode films may be disposed on the principal surface and the end surfaces of the mold resin or may be disposed on other surfaces. Although the electrode films are disposed in a U shape in the second embodiment, the electrode films may be disposed at least on the end surfaces of the mold resin and may be disposed in an L shape from the end surfaces to the second principal surface of the substrate or may be disposed in an L shape from the end surfaces to the second principal surface of the mold resin.

What is claimed is:

1. An electronic component comprising:

a coil component having an element body containing ceramic, a coil disposed in the element body, and an external electrode disposed in the element body and electrically connected to the coil;

a mold resin sealing the coil component;

an electrode film in contact with an outer surface of the mold resin via a metal foil positioned between the electrode film and the mold resin; and a connection conductor disposed in the mold resin and electrically connecting the external electrode and the electrode film, wherein the electrode film and the connection conductor are integral and continuous.

2. The electronic component according to claim 1, wherein one principal surface of the coil component and one principal surface of the mold resin face in a same direction, the electrode film is in contact with the one principal surface of the mold resin, and the connection conductor extends from the one principal surface of the mold resin toward the one principal surface of the coil component.

3. The electronic component according to claim 1, further comprising a substrate, wherein the connection conductor is disposed on the one principal surface of the substrate with the coil component placed on the connection conductor so that the external electrode and the connection conductor are electrically connected, while the mold resin seals the coil component on the one principal surface side of the substrate, and the connection conductor extends along the one principal surface of the substrate and is exposed from an end surface of the mold resin, while the electrode film is in contact with the end surface of the mold resin and in contact with the connection conductor.

4. A method of manufacturing the electronic component of claim 1, the method comprising:

sealing the coil component having the element body containing ceramic, the coil disposed in the element body, and the external electrode disposed in the element body and electrically connected to the coil, with the mold resin; and disposing the electrode film in contact with one principal surface of the mold resin, making a hole from the one principal surface of the mold resin toward one principal surface of the coil component, and disposing the connection conductor in the hole to electrically connect the external electrode and the electrode film.

5. The method according to claim 4, wherein the one principal surface of the coil component and the one principal surface of the mold resin face in a same direction, and the disposing is performed such that the electrode film is in contact with the one principal surface of the mold resin, and the connection conductor extends from the one principal surface of the mold resin toward the one principal surface of the coil component.

6. A method of manufacturing the electronic component of claim 3, the method comprising:

placing the coil component having the element body containing ceramic, the coil disposed in the element body, and the external electrode disposed in the element body and electrically connected to the coil, on the connection conductor disposed on one principal surface of the substrate to electrically connect the external electrode and the connection conductor;

sealing the coil component with the mold resin on the one principal surface side of the substrate; and exposing the connection conductor from the end surface of the mold resin and disposing the electrode film in contact with the mold resin and in contact with the connection conductor.

* * * * *